United States Patent [19]

Mahoney, Jr.

[11] Patent Number: 4,632,565

[45] Date of Patent: Dec. 30, 1986

[54] APPARATUS FOR BLENDING PARTICULATE SOLIDS

[75] Inventor: William J. Mahoney, Jr., Williamsport, Pa.

[73] Assignee: The Young Industries, Inc., Muncy, Pa.

[21] Appl. No.: 665,645

[22] Filed: Oct. 29, 1984

[51] Int. Cl.[4] ..... B01F 5/00; B01F 15/02

[52] U.S. Cl. ..... 366/113; 222/199; 222/200; 366/118; 366/134; 366/182; 366/192; 366/341

[58] Field of Search ..... 366/113–116, 366/118, 119, 131, 132, 134, 136, 137, 154, 159, 182, 184, 192, 341; 222/196, 198–200

[56] References Cited

U.S. PATENT DOCUMENTS

| | | | |
|---|---|---|---|
| 3,106,385 | 10/1963 | Arthur et al. | 366/134 |
| 3,138,369 | 6/1964 | Bennett et al. | 366/134 X |
| 3,158,362 | 11/1964 | Seifarth | 366/134 |
| 4,408,889 | 10/1983 | Peschl | 366/341 X |
| 4,472,064 | 9/1984 | Goins | 366/137 X |

*Primary Examiner*—Timothy F. Simone
*Attorney, Agent, or Firm*—Lalos, Keegan & Kaye

[57] ABSTRACT

A single-pass blending apparatus for blending particulate solids including a blending bin having a bin wall, an upper bin end, a lower bin end, a first bin opening passing through the bin wall, and a second bin opening passing through the bin wall and spaced vertically and horizontally from the first bin opening. The bin wall defines a bin chamber. A plurality of flow openings pass through the lower bin end. A blending chamber is positioned beneath the bin chamber and communicates with the bin chamber through the flow openings. A first external blending tube is positioned outside of the blending bin and has an upper tube end communicating with the first bin opening and a lower tube end external of the bin chamber and communicating with the blending chamber. A second external blending tube is positioned outside of the blending bin and has an upper tube end communicating with the second bin opening and a lower tube end external of the bin chamber and communicating with the blending chamber. A diffuser cone control valve closes off the lower tube ends of the first and second external blending tubes and the flow openings, and, after the external blending tubes and the bin chamber have been filled, opens the lower tube ends and the flow openings to simultaneously allow the material in the lower tube ends and adjacent the flow openings to flow together into the blending chamber.

20 Claims, 4 Drawing Figures

APPARATUS FOR BLENDING PARTICULATE SOLIDS

BACKGROUND AND FIELD OF THE INVENTION

This invention relates to apparatuses for blending particulate solids and further to gravity flow type of blenders wherein the granular or particulate solids are withdrawn simultaneously from a multiplicity of levels within a heterogeneous mass of the solids at various locations about the mass and thereafter recombined. It more particularly relates to so-called single-pass type blenders.

Prior apparatuses for blending dry particulate solids are comprised of mechanical devices or gravity flow type bulk silos. The mechanical devices utilized rotating agitators, rotating shells, and mechanical or pneumatic conveyors to blend the powdered solids. These devices hve the disadvantages though of small capacities, high horse power requirements, and the fact that they are expensive to construct. The gravity flow devices are limited, however, to free-flowing granular materials and comprise basically a large container for holding a bulk quantity of material, with a plurality of tubes having inlets located around the container. The particles are drawn and flow under the force of gravity to a common blending chamber. The granuler solids can either be withdrawn from the unit or re-circulated to the top of the large container.

In the prior art, gravity blenders have a disadvantage of a start-up heel occurring when the blender is filled. The first material charged into the unit goes directly to the blending chamber and is unblended. The normal procedure in the past to correct this problem has been to discard this start-up heel of material or to re-circulate all of the material to the top of the unit for additional blending.

Blenders of the prior art are limited to materials that are free-flowing when acting under the influence of gravity. The inlet to the blending tubes extends into the blending bin typically. This presents a restriction to the flow of material. Further, the blending flow control devices of past gravity blenders were designed such that unless the material was free-flowing, it would tend to bridge in the blending chamber. Thus, past gravity blenders were unable to efficiently handle materials having sluggish flow characteristics.

OBJECTS OF THE INVENTION

Accordingly, it is the principal object of the present invention to provide an improved blending apparatus for blending particulate solids.

Another object is to provide a gravity-flow particulate solids blender which is capable of providing a high degree of homogeneity to a mass of heterogeneous material in a single pass through a blender without requiring the re-circulation of the material.

A further object is to provide a blender that does not leave a start-up heel of the material in the unit that must be discarded or recirculated.

A still further object is to provide an improved apparatus for gravity blending which can be quickly and easily installed in existing facilities.

Another object is to provide an apparatus for gravity blending which can be quickly and easily cleaned.

A further object is to provide an apparatus for uniformly blending particular solids that have sluggish flow characteristics.

A still further object is to provide an apparatus for blending particulate solids that is compact and of comparatively simple construction.

Other objects and advantages of the present invention will become more apparent to those persons having ordinary skill in the art from the following description taken in conjunction with the accompanying drawings.

THE DRAWINGS

DETAILED DESCRIPTION OF THE INVENTION

Figure 1:
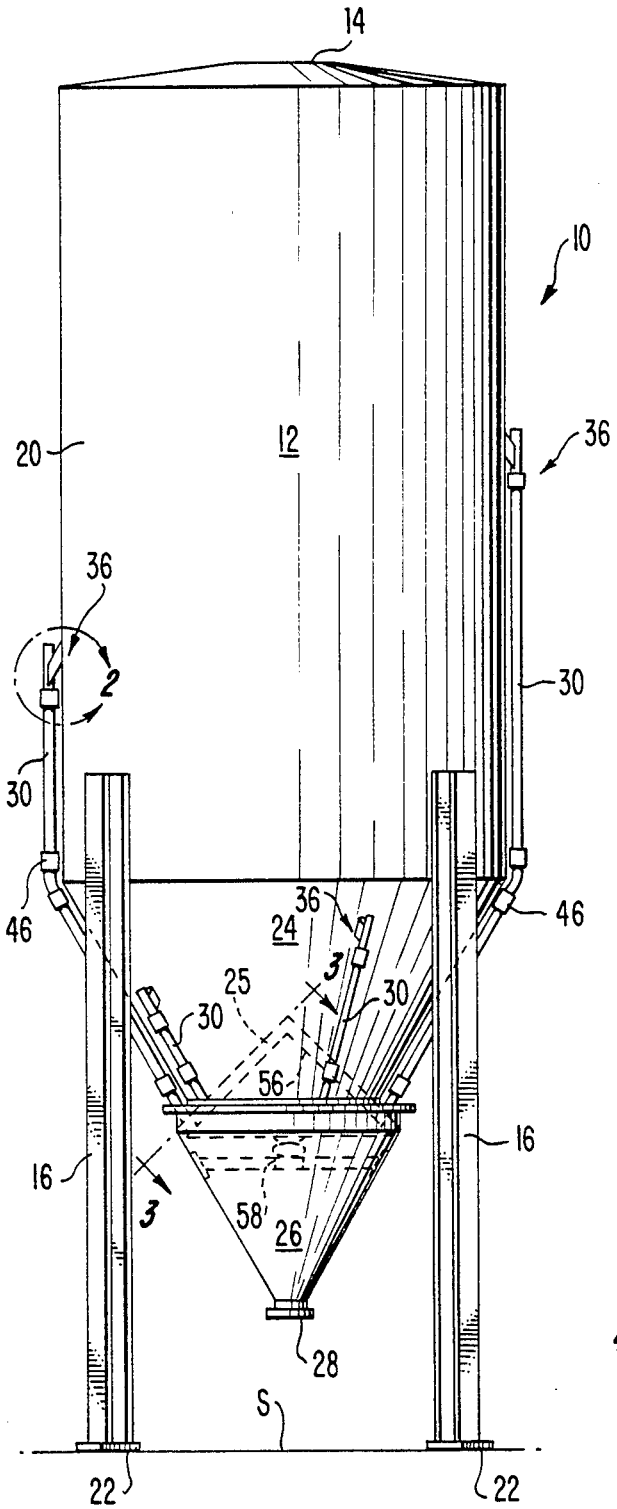
FIG. 1 is a side-elevational view of a blender illustrating the present invention.

Referring to FIG. 1, an embodiment of the present invention is illustrated generally at 10. Apparatus 10 includes a blending bin 12, which may be formed into a cylindrical housing from stainless steel, aluminum, steel or the like. It is also within the scope of the present invention to utilize an existing storge silo or hopper and modify it according to the present invention. Blending bin 12 has a material receiving port 14 at its upper end which can communicate with a pneumatic conveyor (not shown) or the like to permit the entry of a mass of heterogeneous material or materials into the blending bin. It is also within the scope of the present invention to provide a cap (not shown) which can selectively open or close material receiving port 14. The blending bin 12 is supported on its support surface S by a plurality of support legs 16 formed, for example, of elongated steel channels with pads attached to the upper end which are welded or bolted to the upper cylindrical wall portion 20 of blending bin 12 and with a floor mounting plate 22 attached to the lower end thereof to contact support surface S and provide support for apparatus 10.

A downwardly-converging conical portion 24 is attached to and depends from upper cylindrical wall portion 20 of the blending bin. The material in the storage bin will flow from conical portion 24 through diffuser cone 25 to a lower blending chamber 26 which is attached to and depends from lower conical portion 24. The blending chamber 26 at its lower end has an opening 28 which can be opened and closed and when opened communicates with a pneumatic conveying passageway (not shown) or similar collection assembly.

Figure 2:
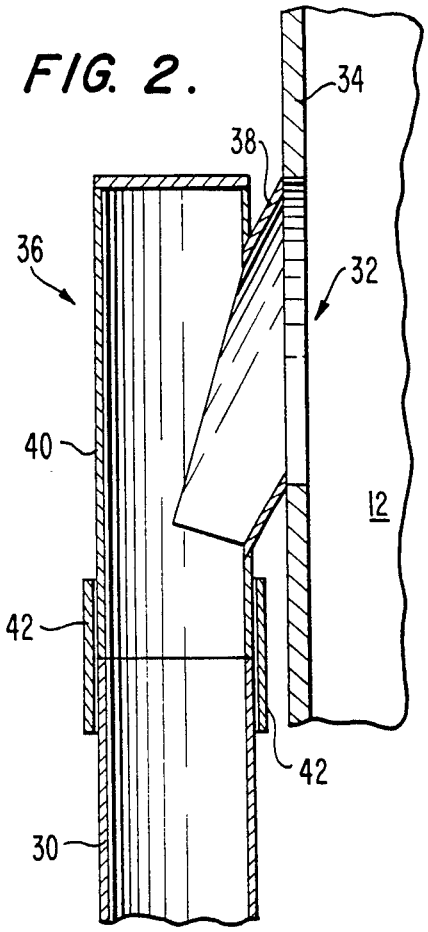
FIG. 2 is an enlarged cross-sectional view taken along line 2 of FIG. 1.

A plurality of external blending tubes 30 are provided, each being connected through an opening 32 flush with the interior surface of exterior wall 34 of the blending bin through a tube connecting mechanism, which is best shown at 36 in FIG. 2. Referring thereto it is seen that connecting mechanism 36 comprises a short downwardly sloping connecting tube 38 being connected at its upper end to exterior wall 34 and at its lower end to a generally vertical blending tube inlet manifold or connection 40. The blending tube inlet manifold 40 is then connected to blending tube 30 by a suitable compression coupling means 42. The flush openings 32 in wall 34 allow blending tubes 30 to utilize the forces of the arch of the solids material in blending bin 12 to push the materials into the blending tubes. It is thus not necessary to have the inlet projections in the blending container as previously were needed. An alternative embodiment (not shown) positions the blending tubes on the inside sidewalls of the blending bin.

The lower ends of external blending tubes 30 communicate directly with the openings 44 in diffuser cone 25. Although only four blending tubes 30 are shown in FIG. 1, it is anticipated that about twenty spaced external blending tubes would be utilized. Also, as best shown in FIG. 1, it is desirable for each of the blending tubes 30 to communicate with the interior of the blending chamber through openings 32 which are positioned at locations about the blending bin spaced both vertically and horizontally. These tubes, though pictured in the drawings as being circular, can also have a cross-sectional configuration which is square, rectangular or any similar shape. Additionally, it is also within the scope of the present invention to provide for couplings 46 for connecting the portions of tubes 30 adjacent the cylindrical wall portion 20 and the conical portion 24 so that the tubes can closely follow the exterior contour of the bin. Also, the blending tubes can be equipped with suitable sight glsses (not shown).

Figure 4:
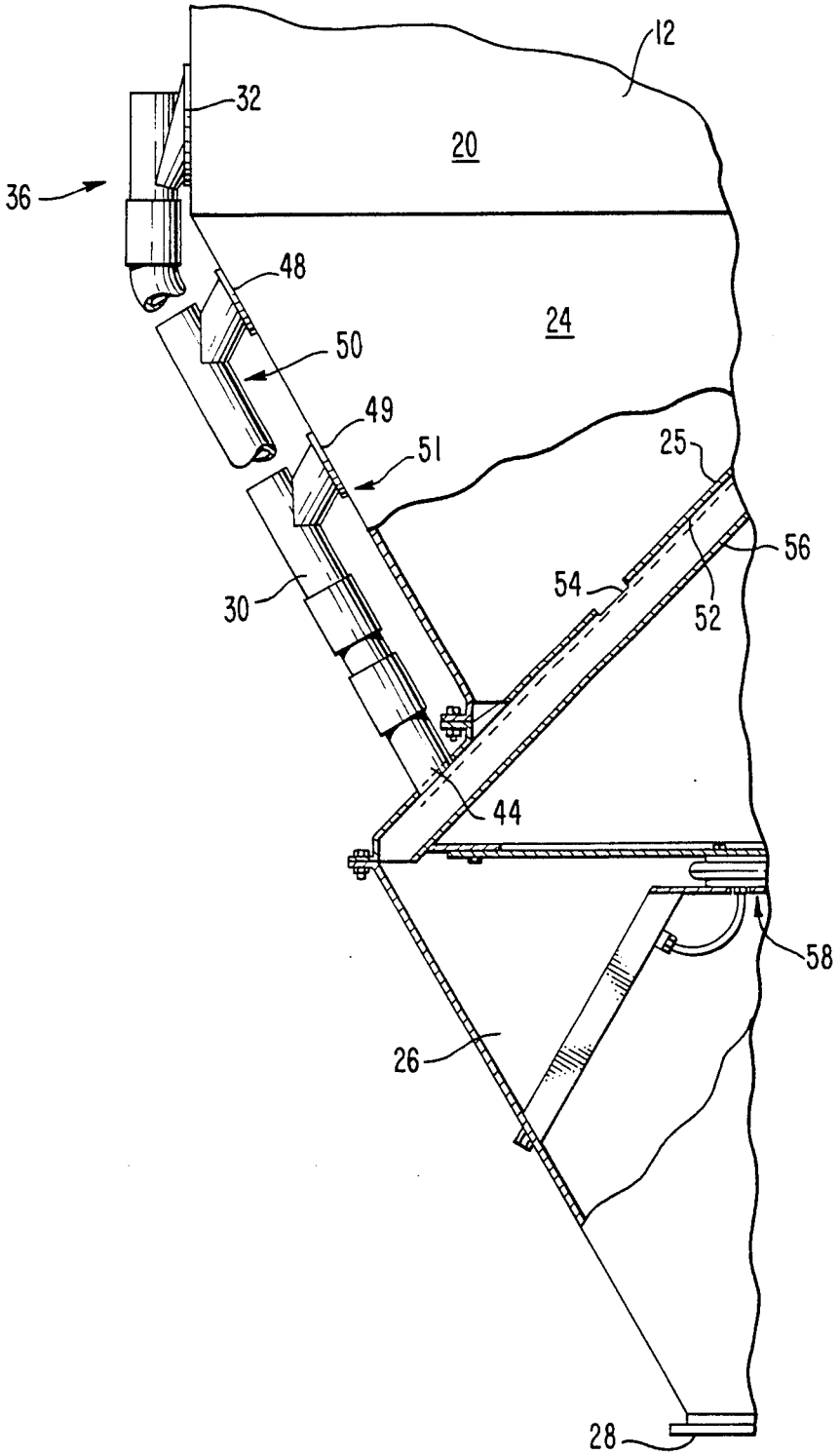
FIG. 4 is an enlarged, fragmentary cross-sectional view taken along line 4—4 of FIG. 3 illustrating a second embodiment of the present invention.

The design of the blending tubes 30 of the apparatus 10 of FIG. 1 provides for only a single communication opening 32 directly to the interior of the blending chamber. The alternative embodiment of FIG. 4 provides for a multiplicity of openings 32, 48, 44 with suitable connection members 36, 50, 51, respectively, passing through both the cylindrical wall 20 and the conical wall 24 of the bin chamber. This provides for material to flow from more than one horizontal plane of the bin into the same blending tube. This modified embodiment of FIG. 4 handles well the space restrictions of smaller units.

Figure 3:
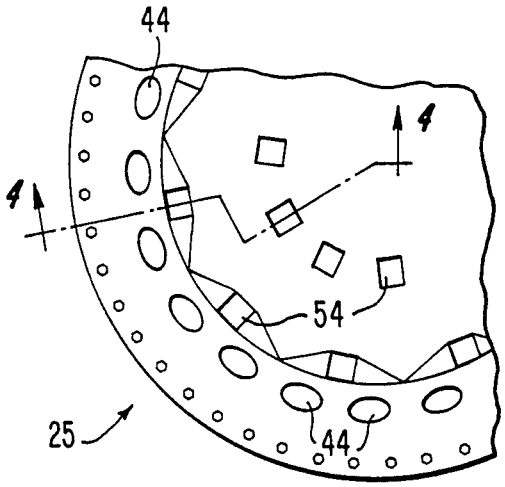
FIG. 3 is an enlarged, fragmentary cross-sectional view taken along line 3—3 of FIG. 1.

As best shown in FIG. 4, diffuser cone 25 comprises a chamber lower conical surface 52 having a plurality of openings 54 therethrough. As illustrated in FIG. 3, it is anticipated that twenty openings through diffuser cone 25 evenly spaced will be provided communicating the lower interior of the conical portion 24 with blending chamber 26 and twenty exterior openings 44 provided so that each of the twenty blending tubes 30 can communicate with blending chamber 26. A conical vibrating flow control valve 56 is positioned beneath the cone surface 52 and is configured to mate against the surface when in its uppermost position thereby blocking all of the external and internal openings. An actuator 58 positioned beneath the flow control valve 56 moves the valve between its uppermost position closing the openings and its lower position spaced from surface 52 allowing the material to pass through the openings 44, 54 and flow directly into the blending chamber 26. Actuator 58 can be pneumatically, electrically, or hydraulically actuated, and either stationary or vibrating. It will be appreciated that when the valve is moved to its lower position all of the openings, both the external and internal, will open at the same time. The present invention also provides that actuator 58 can be adapted to vibrate the flow control valve during the blending cycle. This allows the present invention to handle materials having sluggish flow characteristics which previously could not be effectively blended in a single-pass blending apparatus.

As can be appreciated, the optimum blending is achieved in gravity blenders such as the present one when the blender has the most areas or inlets to the blending tubes. The present invention utilizes the most efficient placement of the blending tube inlets and still allows a compact arrangement in the blending chamber. Single pass blending is achieved by sealing off all of the outlets of the blending bin openings at the time the blender apparatus is filled. At the start of the blending cycle, the valve is open and the material from all areas of the silo are combined simultaneously. It is thus not necessary to discard or recirculate the "startup heel" of material.

From the foregoing detailed description, it will be evident that there are a number of changes, adaptations and modifications of the present invention which come within the province of those skilled in the art. However, it is intended that all such variations, not departing from the spirit of the invention, be considered as within the scope thereof as limited solely by the appended claims.

What is claimed is:

1. An apparatus for blending particulate materials comprising means defining an upper chamber for holding a supply of particulate material, said material holding means having at least one wall, said wall of said material holding means having at least two outlet ports spaced vertically and about a perimeter of said material holding means for receiving therethrough particulate material from said upper chamber by gravity flow, means defining a lower chamber for blending particulate materials, said material blending means having at least one wall, said wall of said blending means having at least two inlet ports, conduits disposed externally of said material holding means and said material blending means, each intercommunicating one of said outlet ports and one of said inlet ports for conveying a stream of particulate material from said upper chamber to said lower chamber by gravity flow, valve means disposed in said material blending means, movable between closing and opening positions relative to said inlet ports, and means for operating said valve means.

2. An apparatus according to claim 1 wherein each of said conduits includes an inlet section communicating directly with an outlet port and disposed at an acute angle to the vertical to facilitate the free flow of particulate material from the upper chamber, through an outlet port and into a conveying conduit.

3. An apparatus according to claim 1 wherein said valve operating means includes means for vibrating said valve means to facilitate the free flow of particulate material through said inlet ports and the blending thereof in said lower chamber.

4. An apparatus according to claim 1 wherein said inlet ports are disposed at the same level.

5. An apparatus according to claim 1 wherein said wall of said material blending means is conically configured.

6. An apparatus according to claim 5 wherein an inner surface of said conically configured wall of said material blending means provides a valve seat and said valve means includes a valve element having a conically configured surface engageable with said valve seat for closing said inlet ports.

7. An apparatus according to claim 1 wherein said wall of said material blending means includes a portion forming a partition between said upper and lower chambers.

8. An apparatus according to claim 7 wherein said partition portion includes at least one opening intercommunicating said chambers whereby particulate material may flow directly from said upper chamber into said lower chamber.

9. An apparatus according to claim 7 wherein said wall of said material blending means is conically configured.

10. An apparatus according to claim 9 wherein said partition portion includes at least one opening intercommunicating said chambers whereby particulate material may flow directly from said upper chamber into said lower chamber.

11. An apparatus according to claim 1 wherein said material holding means includes a cylindrical side wall and an inverted, conically configured bottom wall, said cylindrical and conical walls including a plurality of vertically and circumferentially spaced outlet ports and including a plurality of downcomer conduits, each intercommunicating one of said outlet ports and one of said inlet ports.

12. An apparatus according to claim 11 wherein each of said conduits includes an inlet section communicating directly with an outlet port and disposed an an acute angle to the vertical to facilitate the free flow of particulate material from the upper chamber, through an inlet port and into a conduit.

13. An apparatus according to claim 11 wherein said valve operating means includes means for vibrating said valve means to facilitate the free flow of particulate material through said inlet ports and the blending thereof in said lower chamber.

14. An apparatus according to claim 11 wherein said inlet ports are disposed at the same level.

15. An apparatus according to claim 11 wherein said wall of said material blending means is conically configured.

16. An apparatus according to claim 15 wherein an inner surface of said conically configured wall of said blending means provides a valve seat and said valve means includes a valve element having a conically configured surface engageable with said valve seat for closing said inlet ports.

17. An apparatus according to claim 11 wherein said wall of said blending means includes a portion forming a partition between said upper and lower chambers.

18. An apparatus according to claim 17 wherein said partition portion includes at least one opening intercommunicating said chambers whereby particulate material may flow directly from said upper chamber into said lower chamber.

19. An apparatus according to claim 17 wherein said wall of said material blending means is conically configured.

20. An apparatus according to claim 19 wherein said partition portion includes at least one opening intercommunicating said chambers whereby particulate material may flow directly from said upper chamber into said lower chamber.

* * * * *